United States Patent [19]

Koffski

[11] 4,247,083

[45] Jan. 27, 1981

[54] WALL LIFTER

[76] Inventor: Leonard E. Koffski, R.R. #4, 7534 Trans Canada Highway, Duncan, British Columbia, Canada, V9L 3W8

[21] Appl. No.: 91,508

[22] Filed: Nov. 5, 1979

Related U.S. Application Data

[63] Continuation-in-part of Ser. No. 923,361, Jul. 10, 1978, Pat. No. 4,181,289.

[51] Int. Cl.[3] ..... B66F 1/00

[52] U.S. Cl. ..... 254/107

[58] Field of Search ..... 254/105-107, 254/69-70

[56] References Cited

U.S. PATENT DOCUMENTS

| | | | |
|---|---|---|---|
| 1,270,906 | 7/1918 | Whitney | 254/107 |
| 2,217,403 | 10/1940 | Gunn | 254/106 |
| 2,849,211 | 8/1958 | Shoesmith | 254/106 |

FOREIGN PATENT DOCUMENTS

| | | | |
|---|---|---|---|
| 495603 | 6/1954 | Italy | 254/107 |
| 606344 | 8/1948 | United Kingdom | 254/106 |

*Primary Examiner*—Robert C. Watson

*Attorney, Agent, or Firm*—Stevens, Davis, Miller & Mosher

[57] ABSTRACT

A wall lifter able to be made to climb a column to lift a prefabricated wall into a predetermined position. The lifter comprises a first sleeve to surround the column. A saddle engages the wall. The saddle extends forwardly of the first sleeve and is mounted on the sleeve. A lever is pivotably mounted on the first sleeve adjacent the saddle. There is a fulcrum point for the first lever. A second sleeve surrounds the column and is disposed above the first sleeve when the lifter is in its useful position. There is a link between the second sleeve and the lever, pivotably connected to both. A resilient member urges the lever upwardly. The lifter is easy to use and to make and relatively cheap.

7 Claims, 2 Drawing Figures

WALL LIFTER

CROSS REFERENCE TO RELATED APPLICATION

This application a continuation-in-part of my application Ser. No. 923,361 filed July 10, 1978 now U.S. Pat. No. 4,181,289.

FIELD OF THE INVENTION

This invention related to a wall lifter particularly useful in the lifting of prefabricated walls.

DESCRIPTION OF PRIOR ART

Devices for lifting walls, particularly prefabricated walls of wood, are known. However, they are expensive, an undesirable characteristic particularly in a tool that need not be used very frequently. The present invention therefore seeks to provide a wall lifter that is relatively cheap and easy to make and, in a typical embodiment, merely requires the use of a piece of 2" by 4" timber such as is available on any building site. This piece of timber is used as a column and the wall lifter is made to climb the column while also engaging the upper edge of the wall.

SUMMARY OF THE INVENTION

Thus, in a first aspect, the present invention is a wall lifter able to be made to climb a column to lift a prefabricated wall into a predetermined position, the lifter comprising a first sleeve to surround the column; a saddle to engage the wall mounted on the first sleeve and extending forwardly of the first sleeve; a lever pivotably mounted on the first sleeve adjacent the saddle and able to raise and tilt said first sleeve; a fulcrum point for the first lever; a second sleeve to surround the column disposed above the first sleeve when the lifter is in its useful position; resilient means extending from the second sleeve to urge the lever upwardly; and a link between the second sleeve and the lever pivotably connected to the second sleeve and the lever.

The pivotal connection of the lever to the link may define the fulcrum for the lever. Preferably the lever comprises a U bracket to extend around the first sleeve; a pivotal sleeve at the end of and extending between the limbs of the U, adjacent the saddle to contact the column when the lifter is in use; pivotal joints at each side of the U defining fulcrum points on each side of the lifter and a handle extending outwardly from the base of the U.

Desirably there is a first roller to abut one side of the column adjacent the saddle, positioned in the first sleeve, and a second roller to abut the other side of the column, remote from the first, in the second sleeve and adjacent the link connection.

BRIEF DESCRIPTION OF DRAWINGS

The invention is illustrated, merely by way of example, in the accompanying drawings in which.

DESCRIPTION OF THE PREFERRED EMBODIMENTS

Figure 1:
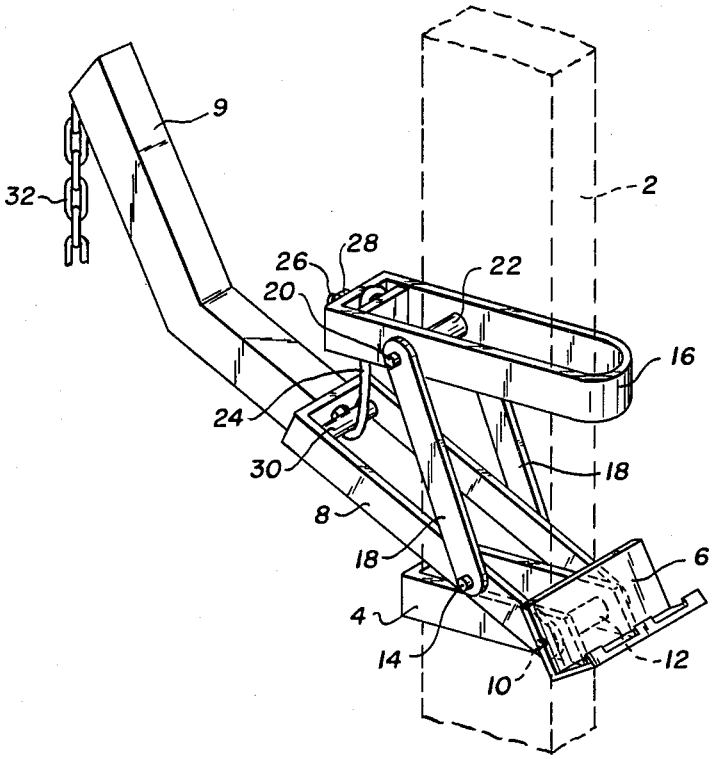
FIG. 1 is a perspective view of a lifter accordding to the invention.

FIG. 1 illustrates a wall lifter able to be made to climb a column 2 (shown in broken lines) to lift a prefabricated wall (not shown) into a predetermined position.

The lifter comprises a first sleeve 4 to surround the column 2. A saddle 6 engages a top of the wall to be lifted. The saddle 6 extends forwardly of the first sleeve 4 and is mounted, for example by welding, to the sleeve 4.

A lever 8 is pivotably mounted to the first sleeve 4 at a position adjacent the saddle 6. Mounting of the lever 8 is by a pivot pin 10 extending through aligned holes in the lever 8 and in the side walls of the first sleeve 4. A tube 12 is free to rotate on the pin 10 between the side walls of the first sleeve 4, against the column 2. In the illustrated embodiment the lever 8 comprises a U-bracket that extends around the first sleeve 4. A handle 9 extends from the base of the U.

A fulcrum point for the lever 8 (which is a primary lever) is provided by lugs 14 at each side of the limbs of the U.

A second sleeve 16 surrounds the column 2 and is disposed above the first sleeve 4 when the lifter is in its useful position as shown in the drawings.

There are links 18 between the first sleeve 4 and the second sleeve 16 pivotably connected to each sleeve. The connection to the second sleeve 16 is simply provided by aligned holes receiving a pivot pin 20. A tube 22 is free to rotate on the pin 20 between the side walls of the second sleeve 16 against the column 2. For the first sleeve 4, the pivotable connections are the lugs 14 on each limb of the U of the lever 8, which extend through clear holes in the links 18.

Figure 2:
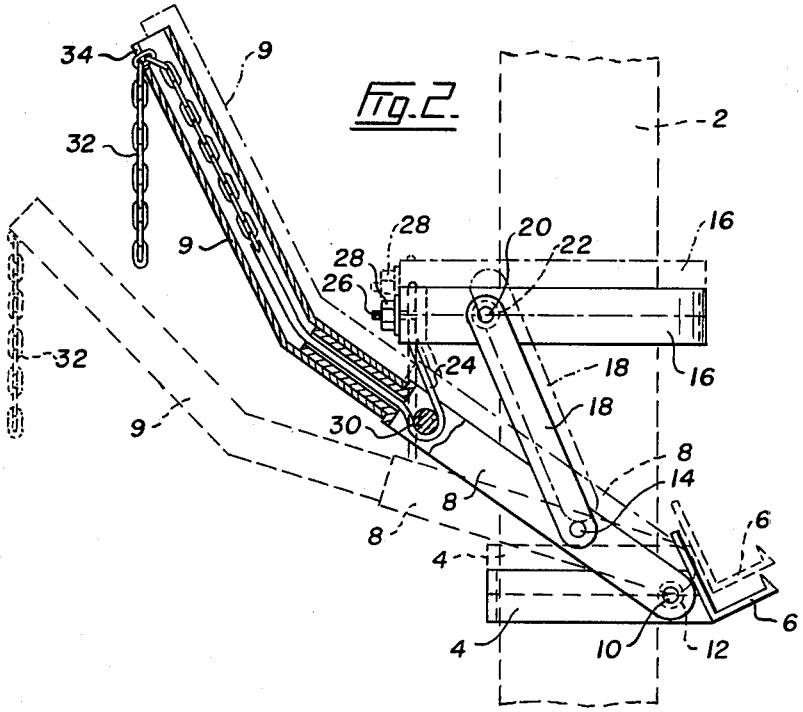
FIG. 2 illustrates the operation of the lifter of FIG. 1.

The handle 9 and lever 8 are provided with a resilient means attached to the second sleeve 16 to urge the lever 8 upwardly. In the illustrated embodiment an elastic cord 24 extends from an anchor on the second sleeve 16. The anchor simply comprises a bolt 26 extending through a hole in the second sleeve 16 to receive a nut 28. By tightening the nut 28 the elastic member 24 is properly located at the second sleeve 16. The elastic member extends downwardly around a fixed tubular member 30 and extends into the handle 9, which is hollow as indicated in FIG. 2. The elastic member is attached to a chain 32 which passes out through the open end of the handle 9. The chain 32 can be engaged in a slot 34, which provides a means of locking the chain 32 in a predetermined position relative to the handle. Chain 32 extends outwardly of the handle and is thus useful when the handle 9 is too high to be gripped by a workman. The hanging chain 32 can then be gripped by the workman and pulled to operate the device even though the handle 9 cannot be reached. It will be appreciated that the use of a simple slot 34, on which the chain may grip, and which is wide enough to permit a link to pass through in a first position but not wide enough to permit the link to pass through when it is turned 90°, provides an anchor means for the chain 32 and also permits variation in the anchor position of the chain.

It is desirable that the lifter be associated with a non-slip shoe that contacts the base of the column 2 to prevent its slipping during lifting of a prefabricated wall. The non-slip shoe is described in application Serial No. 923,361, the disclosure of which is incorporated by reference.

The use of a bracket according to the invention is illustrated particularly in FIG. 2. When it is desired to lift a prefabricated wall into a predetermined position in a building the saddle 6 is placed beneath a top member of the wall. The column 2 is inserted in the aligned first and second sleeves 4 and 16. Hand pressure is applied downwardly to the handle 9 causing the first sleeve 12 to rise up the column 2 by rolling of the tube 12. The handle is released and the elastic cord 24 immediately returns the handle to the raised position shown in FIG. 1. At the same time the downwardly acting weight of the wall on the saddle 6 maintains the saddle and thus the first sleeve 4 in position. The link 18 moves upwardly with upward movement of the handle 9 causing the second sleeve 16 to rise up the column, with rotation of the tube 22. Downward pressure of the handle tends to increase the frictional engagement of the tube 22 with the column 4 acting as an anchor while the first sleeve 4 is moved from its rest position, where the tube 12 is in fixed engagement with the column 2, as the operator takes the weight of the prefabricated wall by pulling downwardly on the handle 9. When the prefabricated wall reaches a certain height, normally too high for effective operation by the operator, the chain 32 acts as an extension of the handle so the device can still be operated.

The lifter may be made of mild steel plate. The chain may be of galvanized steel and an effective elastic cord has proved to be 5/16" diameter surgical rubber.

I claim:

1. A wall lifter able to be made to climb a column to lift a prefabricated wall into a predetermined position, the lifter comprising:

a first sleeve to surround the column;

a saddle to engage the wall mounted on the first sleeve and extending forwardly of the first sleeve;

a lever pivotably mounted on the first sleeve adjacent the saddle and able to raise and tilt said first sleeve, a fulcrum point for the first lever;

a second sleeve to surround the column disposed above the first sleeve when the lifter is in its useful position;

resilient means extending from the second sleeve to urge the lever upwardly; and a link between the second sleeve and the lever pivotably connected to the second sleeve and the lever.

2. A wall lifter as claimed in claim 1 in which the pivotal connection of the lever to the link defines said fulcrum for the lever.

3. A wall lifter as claimed in claim 1 in which the lever comprises a U-bracket to extend around the first sleeve;

a pivotable sleeve at the end of and extending between the limbs of the U, adjacent the saddle to contact the column when the lifter is in use;

pivotable joints at each side of the U defining fulcrum points on each side of the lifter; and a handle extending outwardly from the base of the U.

4. A wall lifter as claimed in claim 1 including a non-slip shoe associated with the lifter to engage and anchor the base of the column during the lifting of the wall.

5. A wall lifter as claimed in claim 1 in which there is a first roller to abut one side of the column, adjacent the saddle, in the first sleeve; and a second roller to abut the other side of the column, remote from the first, in the second sleeve at the link connection.

6. A wall lifter as claimed in claim 5 including an anchor in the second sleeve for resilient means;

said means extending from the anchor to attach to the lever.

7. A wall lifter as claimed in claim 6 in which the lever is hollow and the resilient means is attached to anchoring means within the lever;

means to permit variation in the anchored position of the anchoring means.

* * * * *